United States Patent [19]

Meier-Windhorst

[11] 4,056,954

[45] Nov. 8, 1977

[54] APPARATUS FOR WET TREATMENT OF TRAVELLING WEBS

[76] Inventor: Christian August Meier-Windhorst, 2101 Lindhorst uber, Hamburg-Harburg, Germany

[21] Appl. No.: 648,349

[22] Filed: Jan. 12, 1976

Related U.S. Application Data

[62] Division of Ser. No. 580,453, May 23, 1975, Pat. No. 4,004,879.

[30] Foreign Application Priority Data

May 25, 1974 Germany ..... 2425374

[51] Int. Cl.[2] ..... D06B 3/02

[52] U.S. Cl. ..... 68/22 R; 68/62; 68/181 R; 68/205 R

[58] Field of Search ..... 68/5 D, 5 E, 19.1, 20, 68/22 R, 27, 43, 62, 175, 181 R, 184, 205 R, 208

[56] References Cited

U.S. PATENT DOCUMENTS

| | | | |
|---|---|---|---|
| 761,107 | 5/1904 | Rovira | 68/5 E |
| 1,209,465 | 12/1916 | Matter | 68/5 E |
| 2,736,183 | 2/1956 | Arnold | 68/27 X |
| 3,722,233 | 3/1973 | Meier-Windhorst | 68/181 R X |
| 3,950,802 | 4/1976 | Schiffer et al. | 68/181 R X |

FOREIGN PATENT DOCUMENTS

| | | | |
|---|---|---|---|
| 531,478 | 9/1954 | Belgium | 68/181 R |

*Primary Examiner*—Philip R. Coe
*Attorney, Agent, or Firm*—Allison C. Collard

[57] ABSTRACT

Apparatus for continuous wet treatment of elongated materials, such as travelling textile webs and the like, namely for soaking the webs with liquids, applying chemicals thereto, dyeing, washing and rinsing them. The web is passed through a closed space, preferably in an upward direction, between two rows of vertically spaced-apart rollers. The travelling web is subjected to a short-duration action of a hot liquid in at least two separate, consecutive stages which can be in the form of dish-shaped containers that hold the liquid underneath some of in a hot gaseous medium for a longer time than the liquid exposure; and the liquid adhering to the travelling web is squeezed out between at least two consecutive liquid stages, and preferably returned to a container of a stage through which the web was previously guided.

5 Claims, 2 Drawing Figures

APPARATUS FOR WET TREATMENT OF TRAVELLING WEBS

Figure 1:
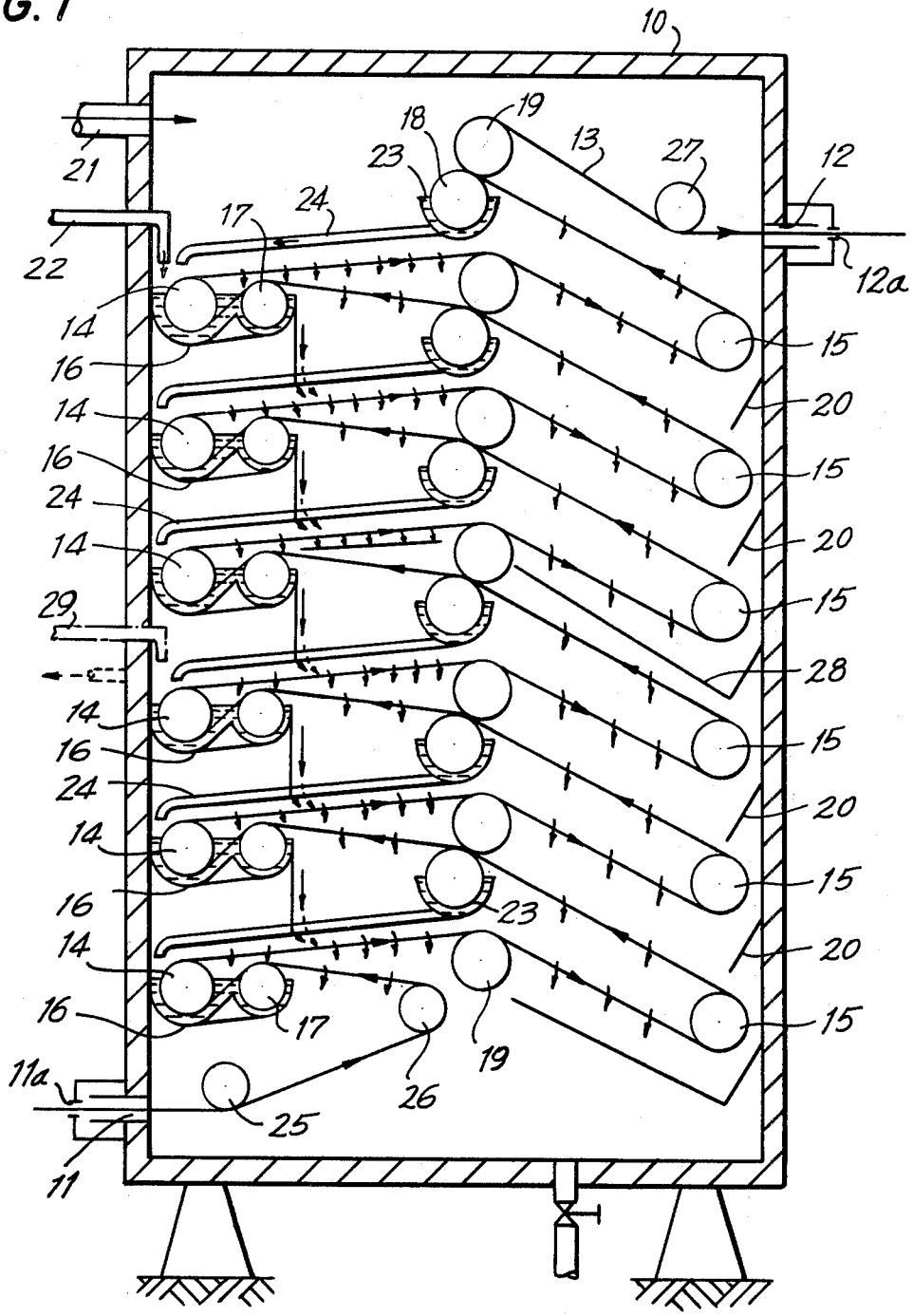

This is a division of application Ser. No. 580,453 filed on May 28, 1975 now U.S. Pat. No. 4,004,879.

The invention relates to an apparatus for continuous wet treatment, especially for washing travelling webs.

More particularly, the invention relates to an apparatus for a continuous treatment of webs, especially textile webs, with liquids; these are for example chemicals acting on the webs, e.g. bleaching agents; or for transferring substances onto the webs, such as dyes; or for washing or rinsing the webs to remove excessive treatment agents or impurities therefrom.

Known continuous processes for wet treatment, particularly treatment with chemicals or for washing travelling webs, are predominantly so designed that the web is passed through a sequence of serially arranged partial treatments by liquids in various washing apparatus with compartments, which may be open or closed. In a preferred arrangement, the webs are passed over upper and lower guide rollers in substantially vertical direction. In this process, containers are arranged below the lower rollers, which receive the treatment liquid, where an intimate contact between the web and the treatment liquid takes place so that the web becomes soaked with the liquid and the desired action of the same on the web is made to occur.

Above the containers and the liquid therein, the web is freely guided in various manners, preferably in a closed space, usually with additional heat treatment, in a gaseous medium, preferably steam. Between the partial liquid treatments, intermediate squeezing devices are arranged for removing the liquid, the object of the squeezers being 1. to effect a substantial separation of the treatment liquids of the serially arranged liquid and chemical treatment of different types, especially where treatments with chemical and washing treatments alternate; and
2. to prevent the return flow of larger amounts of treatment liquids onto the web, in the case of a planned counter travel of web and treatment liquid is to take place through several partial treatments.

The disadvantage of these treatment arrangements is the fact that the interruption between the treatment liquids and the web is incomplete, especially in the case of free guidance of the web. On the one hand, when the web is guided substantially vertically, there will be only less effective tangential relative currents between the vertical webs and the treatment liquid running down on them. In that case, the inner core of the web is hardly affected by the treatment. On the other hand, the important contribution in the effect of the treatment agents brought about by the squeezing devices is limited because the latter depend to a large extent on the distribution of the concentration of the treatment agent between one of the surfaces, the inner core, and the other surface of the web.

In newer constructions, serving mostly to washing treatments, the mentioned disadvantages are to be avoided by providing guide or reversing rollers for the webs, primarily passed in horizontal travelling paths, these being mostly laterally arranged series of return rollers over which the web is guided preferably from bottom to top through the treatment, whereas the treatment or washing liquids are admitted to the web preferably by being sprayed on during the horizontal courses.

When in a mode of operation it is intended to obtain planned high effects - while working at considerably increased treatment temperatures - by increased squeezing of the treatment liquid through the web at the rollers, there are again essential disadvantages because in limiting the effects during the free passages to the mentioned places, there will be a very high dependence on the tension of the web and on the speed of passage (centrifugal effects at the guide rollers). In other words, the washing effects will, in any given case, depend on the prevailing operational speed so that a simple adjustment to different operational conditions will be very difficult to attain. Moreover, planned partial treatments in several, different liquid quantities, independently of a certain longer passage of treatment liquid and web, will not be adjustable at all, so that no clearly separated zones be formed that are limited in their lengths for treatments with different liquids containing various treatment agents. This is not even possible by providing simple squeezing or stripping devices without planned coordination to defined sections of the liquid treatment.

The present invention has the object of providing an apparatus which permits to combine under optimum conditions the advantages of various modes of liquid treatments of different kinds, such as chemical treatments, treatments relating to application of coatings or to transfers of agents from liquids, and of washing or rinsing treatments. Each of these treatments includes 1. passing webs through a treatment liquid, to achieve complete absorption by soaking;
2. freely guiding the soaked web through a preferably hot gaseous medium; and
3. squeezing in a planned operation the web, to obtain effective separation of the liquids, while guiding substantial parts of the web at least approximately horizontally, before immersion into the next soaking liquid with either the same or another treatment medium.

It is another object to provide an apparatus bringing about a strong circulation of the treatment liquid between soaking and separating zones by the squeezing action with the purpose of increasing to the utmost the interaction of treatment liquid and web by the following measures:

a. highly increased penetration of portions of the treatment liquid through the web under treatment;
b. highly increased effect on the surface of the web owing to the comparatively large quantities of liquid; and
c. multiplied effects of the same liquid portions on the web due to circulation added to the simple passage (so-called "pilger" effect or pilgrim step motion).

It is also an object of the invention to provide an apparatus capable of achieving an efficient increase in the exchange effects between the treatment liquid or liquids and the material web by a particularly effective interaction through the penetration of the treatment liquid through the web, preferably during its horizontal movement, and the squeezing out of the liquid in the squeezing devices of the individual treatment sections.

The objects and major features of the present invention are achieved by the apparatus according to the invention which comprises a closed housing with two rows of vertically arranged guide rollers for the web, as well as admission and discharge openings therefor.

Each treatment section or zone individually includes 1. a short-duration pure liquid action by passing the web through the treating liquid collected or contained in the respective container;
2. an intensive heat treatment during a somewhat longer free guidance having substantial path sections in a hot gaseous medium; and
3. an effective squeezing of the web before it enters the next successive liquid treatment.

As against hitherto known very substantial horizontal guide-path sections in the longer free guidances, a substantial portion of the treatment liquid entrained by the web is made to pass according to the invention through the web and be absorbed therein.

Also, that portion of the liquid which is released by the squeezing of the web is continuously returned to the starting phase of the treatment, namely to the section which is closed off by the squeezing.

It has been found by careful tests and investigations that it is more effective and reasonable with the inventive apparatus to operate with a higher number of vertically disposed treatment sections but correspondingly shorter treating times than was customary so far with horizontal sections. Owing to the larger number of bath separations this allows the use of simpler, that is lighter squeezing steps.

Considering the economy of operation and the cost of initial investment, it has proven advantageous to make about one-third of the total washing liquid, passing in counter-current fashion, pass as a return flow into the subsequent treatment section of the web, allowing that liquid portion to be entrained by the web while passing through the squeezing devices.

According to a feature recommended by the invention, the heat treatment is performed at the boiling temperature of the used liquid treatment liquids. This expedient makes use of the circumstance that the surface tension of aqueous liquids drops to almost zero in the range of the boiling temperature so that it is possible for the liquid to pass easily through the web, the encountered resistances being substantially reduced.

The treatment space through which the web is made to pass is preferably filled with overheated, air-free steam so as securely and easily to maintain the boiling temperature on the web. It may even be possible to make the treatment liquid boil on the web to some extent. Temperatures of the overheated steam between about 110° to 125° C have proven to be most efficient. By these expedients, treatment effects can be achieved which can be obtained with saturation temperatures only at temperatures higher than 100° C on the web itself, that is by using an overpressure in the treating steam atmosphere.

Figure 2:
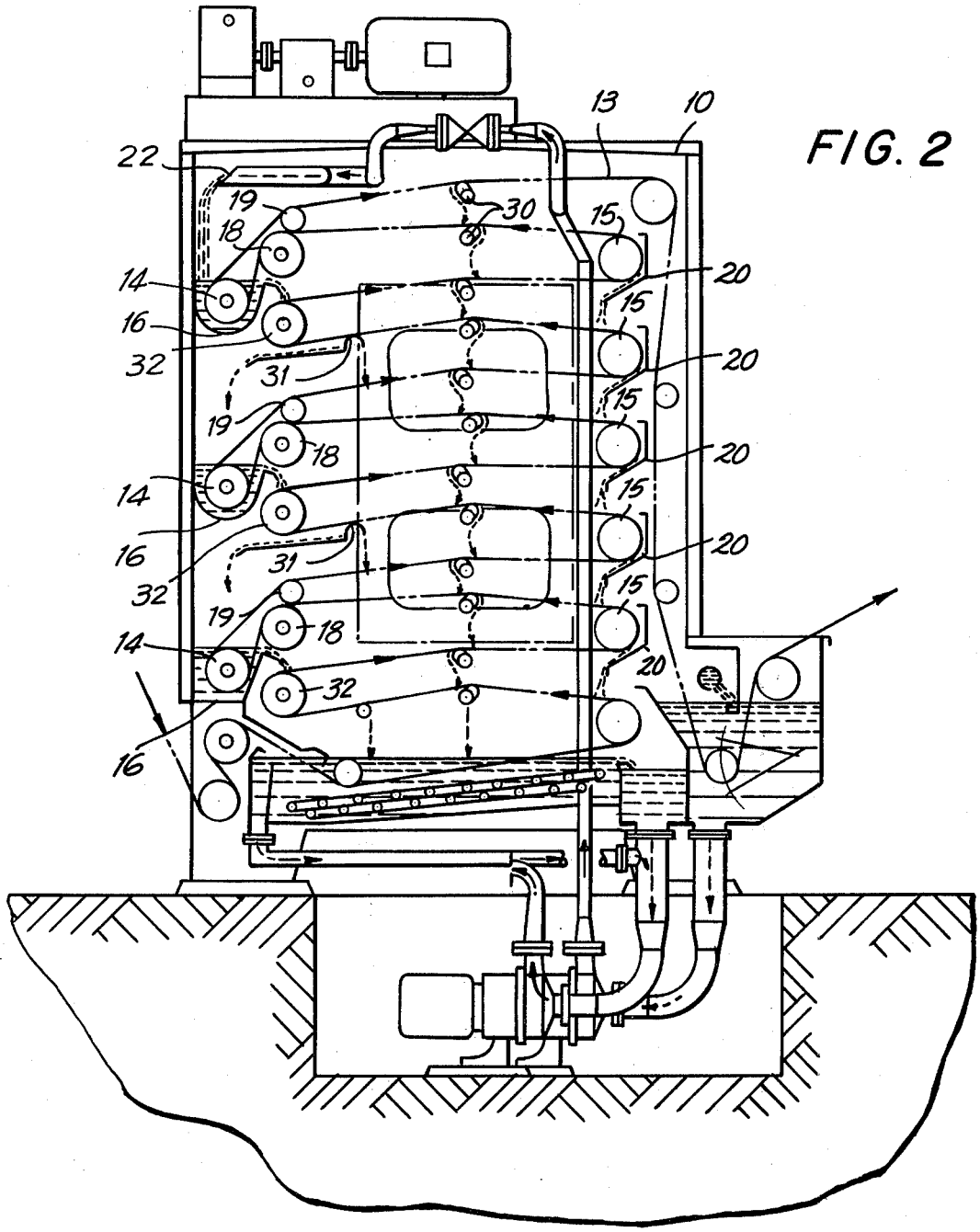

Other objects and many of the attendant advantages of the inventive apparatus will be readily appreciated as the same becomes better understood by reference to the following detailed description, when considered with the accompanying drawings, wherein FIG. 1 illustrates an exemplary embodiment of the device according to the invention, with particular arrangements of several treatment sections for soaking, guiding a web, and squeezing devices; and FIG. 2 illustrates another embodiment of the device, equipped with intermediate guide rollers for the web.

Referring now to FIG. 1, a housing 10 is shown which is insulated in order to maintain the heat inside at boiling temperature of the treatment liquid. A slot-shaped admission opening for a web 13 is designated by numeral 11, a similar slot-shaped discharge opening by 12. The web enters and leaves the housing by contact-free guide means 11*a* and 12*a*, respectively. The slot-shaped openings 11, 12 are so designed that entrance of air and escape of steam is practically avoided. Near the top of the housing 10, a conduit 21 is provided for the admission of a gaseous treatment medium, e.g. steam, particularly overheated steam of about 110° to 125° C, from where the medium is evenly distributed through pipes over the entire treatment space, as is conventional in such devices and has not been shown further in the drawings.

In the housing space, there are a series of double rollers 14, 17 substantially vertically disposed in pairs above each other, as shown, as well as a series of simple reversing rollers 15. The web 13 is passed about these rollers, in the example here shown, from bottom to top in a mostly near-horizontal course. The rollers 14 are placed in dish-shaped shells 16 which contain the treatment liquid. In order to achieve as long an immersion path as possible, with relatively small containers, the rollers 17 serve as guide rollers, directing the introduction of the web 13 from above into the shells 16, and provide at the same time additional soaking. Of the rollers 15, some or all are slidably mounted (not shown) in order to serve for adjusting the tension of the web.

Before the web 13 is passed to each soaking device, that is to say ahead of the rollers 14 and 17, roller pairs 18, 19 are positioned which not only serve as guides for the web but also squeeze the same before it enters the subsequent soaking in shells 16.

Along the wall of the housing, particularly in the area of rollers 15, baffles 20 are attached to the wall, which return the liquid into the treatment cycle, that is thrown off at the points of reversal of the web 13. Such baffles may, of course, be also arranged at other points laterally of the web path.

Furthermore, more or less horizontal panels 28 can be combined with the baffles 20 so that treatment compartments are formed for the web, which are almost completely separated.

The treatment liquid passes to the shells 16 through an admission pipe 22 or, if two liquids are used, also through a pipe 29. The excess liquid remaining on the web after it has passed the several treatment compartments is collected in dishes 23 and returned from there through pipes 24 that are arranged laterally near the web 13, into the shells 16 preceding the web passage.

The course of the treatment is described below for the exemplary device shown in FIG. 1. First, the temperature of the treatment liquid and that of the treatment space is brought up to the boiling point of the preferably aqueous treatment agent. The web 13 enters the treatment space through slot 11 past guide means 11*a* and is then led over an entrance roller 25 to a guide or reversing roller 26. From there, the web enters above the first roller 17 shell 16 filled with the liquid, which it absorbs. Then it passes over roller 14 to the other guide roller 19 and thence to the roller 15. It will be seen from FIG. 1 that the lowermost roller pair may dispense with the roller 18, the reversing roller 26 taking its place. This path and procedure is repeated at each treatment station. The rollers 18, 19 act as squeezing means whereupon the web 13 passes through to the roller 17 of the next treatment section (toward the left-hand side, as shown). At the end, the web 13 is passed over a discharge roller 27, arranged behind the last pair of rollers 18, 19, and leaves the treatment space through the slot 12 and the guide means 12*a*.

The travel direction of the web and of the treatment liquid is shown in FIG. 1 by arrows. The liquid taken up by the web 13 in each shell 16 passes through the web when it travels from rollers 14 to 19, during which time the treatment is effected. In the path below, the liquid is again effective and partly passes through the web, partly returns to the previous treatment space, and is partly returned to the shell 16. Thus, a liquid cycle is formed with a return of substantial portions of the liquid to previous treatment sections from where they are carried back into the treatment spaces by the web itself or by the pipes 24. Thus, according to the invention, there is brought about a substantial circulation of the liquid or liquid mixtures in a so-called pilgrim step motion.

In the treatment area between rollers 18, 19 and between the reversing rollers 15, the liquid on the web penetrates the same and arrives at the respective sections below (see arrows) where it again becomes effective. The web is then squeezed between the next pair of rollers 18, 19, and the surplus liquid is returned to the preceding shell 16, as has been explained before.

Part of the liquid is pressed by means of the rollers 15 through the web surface and passes behind these rollers, seen in the direction of travel. Consequently there is again a circulation in pilgrim step motion with respect to the rollers 18, 19 as well as 15, as described above, an expedient which leads to a particularly advantageous and economical exploitation of the treatment liquid in the individual sections or zones. Uncontrolled intermingling between the successive sections is effectively avoided by the use of the squeezing steps performed with the roller pairs 18, 19. The partitions 28 and the additional liquid admission pipes 29 allow the provision of effectively separated treatment sections.

We are coming now to the description of another exemplary apparatus embodiment, similar to that of FIG. 1 and also incorporating the elements 13 to 16, 18 to 20 and 22 which therefore will not be described again. Although not identified by numerals, this apparatus also has a housing, appropriate admission and discharge openings and guide means (as described for FIG. 1 in respect of the parts 10 to 12, 11*a* and 11*b*), and other elements such as inlet conduits, dish-shaped liquid containers, pipes, various entrance, reversing, guide and discharge rollers, as will no doubt be understood by those skilled in the art. Only the additional and different parts will be described for FIG. 2.

Instead of the simple return path for the web 13 between successive pairs of soaking stations, such as in containers or shells 16 of FIG. 1, this embodiment provides an additional web path across the housing, namely by the provision of additional guide or reversing rollers 32, similar in their role to the rollers 15. Right at the beginning of the treatment, namely in the lower left-hand area of the apparatus, the web is shown to pass after the entrance and guide rollers (the equivalents of 25, 26 in FIG. 1) to the first roller 15 on the right-hand side; and yet, before being led to the first dish unit 16, with the roller 14 in it, the web passes along two transversal sections, and this arrangement is followed successively as the web moves upward and toward its discharge. Consequently the number of rollers 15 in FIG. 2 is twice that of FIG. 1 as compared to the number of treatment sections with the parts 14 and 16.

It can also be seen in FIG. 2 that the pairs of rollers 18, 19 are brought closer to the treatment sections, taking in a way the place of the omitted second roller (17 in FIG. 1).

This overall arrangement provides for a more compact arrangement where more than twice the overall length of the travelling web can be accommodated as compared to the first described arrangement, which consequently makes for a more economical initial set-up. For the same length of web to be treated, the number of dish-shaped containers 16 and rollers 14, 18, 19 is cut in half, and only the reversing rollers 15, 32 are increased in their number.

In a substantially central area of the housing (where the first embodiment had the rollers pairs 18, 19, about half-way between the dishes 16 and the rollers 15), the modified apparatus embodiment has stripping rollers 30 that allow adjoining treatment sections or zones to be used for soaking in or impregnanting the web with different liquids (to the left and the right of these rollers, 30, respectively).

With a view to obtain maximum effect from the stripping rollers 30, their journaling and arrangement alternates from left to right, in a manner to oppose the direction from where the web 13 reaches these rollers. The thus stripped or removed treatment liquid runs off or drips onto the preceding horizontal web path, as illustrated.

This modified embodiment also illustrates the inner compartments for some of the rollers 30 as we described in the introduction of the application.

The role of the baffles and partitions (20, 28) of the previous embodiment is mainly taken over, or supplemented, by stripping edges 31 that are arranged in the web paths that reach the rollers 32 from the respective reversing rollers 15. For convenience, no baffle 20 or stripping edge 31 is shown for the lowermost roller 15 although this can be included if necessary. The stripping edges have extensions that allow the liquid to be guided to above the next lower roller 14 in dish 16 where the liquid is being reapplied, as has been described before. it might be added at this point that the second embodiment does not require the pipes 24 for returning the treatment liquid from the roller pairs 18, 19 to the preceding rollers 14 in dishes 16 because the closeness of the rollers 18, 19 to the dishes, while the edges 31 have a similar function.

In a somewhat schematic manner, FIG. 2 also shows conventional means for introducing, circulating and cleansing one or more treatment liquids. A compressor - pump combination is preferably disposed below the housing, by which the main liquid is raised to the top, to be administered to the highest dish 16 by way of the admission pipe 22; the downward path of the liquid, over dishes 16, rollers 32, and edges 31 with their extensions, is clearly illustrated.

In the upwardly directed outlet pipe of the pump, which terminates in the pipe 22, a filter and/or valve combination may be provided. Above the housing 10, a motor unit is schematically shown, that can be used, for example, for introducing and circulating a gaseous atmosphere, steam, and the like.

At the bottom of the closed housing, a liquid tank is shown through which the web 13 passes, right after having been introduced into the apparatus. This tank may lodge heating coils and the like, as shown, to raise the temperature of the treatment liquid.

An overlfow from the rank leads to a smaller tank section from where, or also from the top of the larger tank, the liquid can be recirculated through the pump. The smaller tank section can receive the liquid that drips off the rollers 15 and the baffles 20 therebelow. Through appropriate valves (not shown), different pump inputs and outlets can be chosen so as to provide maximum versatility in adapting the inventive apparatus to various wet-treatment tasks, as was explained right at the beginning of the introduction.

Finally, a separate exit tank may also be provided, to which the treated web is guided, in a downward direction, by the way of small guide rollers, to receive a final treatment or rinsing in that exit tank. A separate liquid inlet (shown only by way of the end of a pipe) is provided, and a discharge at the bottom, leading to one of the pump inputs, similarly for recirculating the liquid (together or separately from that used in the main treatment sections of the apparatus). These details are clear enough to be understood without a detailed and numbered description thereof.

It should be understood that the apparatus of FIG. 1 can also include the liquid introducing, circulating and cleansing means shown in and described in connection with FIG. 2 although not specifically shown therein. FIG. 1 only shows the inlet conduit 21 (and an auxiliary admission conduit 29, of which there may be more, if required), and an unnumbered discharge outlet at the bottom of the lower space in the housing 10.

It is merely for the sake of convenience and better illustration that some features of the invention are shown in one embodiment and other features in the other. They should be understood to be interchangeable and supplementing each other, thereby producing a unitary and most efficient apparatus for performing the novel wet-treatment procedure, especially for washing travelling webs.

It should be understood, of course that the foregoing disclosure relates only to preferred embodiments of the invention, and that it is intended to cover all changes and modifications of the exemplary embodiments described that do not constitute departures from the spirit and scope of the invention.

What I claim is:

1. An apparatus for the continuous wet treatment of elongated materials, such as travelling textile webs and the like, particularly for washing the same, comprising:

a substantially closed housing, having admission and discharge openings, for the passage of a web therethrough;

a plurality of vertically, spaced-apart and horizontally-disposed liquid treatment stages, each of said treatment stages including a first dish-shaped container located on one side of the interior of said housing, for holding a hot liquid in which the web may be immersed, at least one first guide roller disposed at least partially within said container for guiding and effecting total immersion of the web in the hot liquid contained in the container, a second guide roller disposed on the other side of the interior of said housing, which cooperates with said first guide roller for guiding the web in a generally horizontal travel path across the interior space of said housing, a pair of cooperating and coacting squeeze rollers disposed generally between said first and second guide rollers and between which the web passes prior to immersion in said container of said treatment stage, so as to remove the liquid that adheres to the web after the latter has passed through the container of a preceding treatment stage, thereby separating the preceding and following partial treatments, and a second dish-shaped container disposed beneath said squeeze rollers for collecting excess treatment liquid removed by said squeezing rollers and including means for transmitting the collected excess treatment liquid to the first dish-shaped container of the preceding treatment stage therebelow, said rollers cooperating to successively guide the web generally upwardly through each of said treatment stages; and means for introducing a hot liquid to the first container of the uppermost treatment stage and for successively guiding liquid overflow from a first container onto the web in the preceding treatment stage therebelow and from said web to the first container of said preceding treatment stage.

2. The wet-treatment apparatus as defifned in claim 1 further comprising means associated with some of said rollers for tensioning the web during its passage.

3. The wet-treatment apparatus as defined in claim 1, wherein said means for transmitting the collected excess treatment liquid comprises pipe means.

4. The wet-treatment apparatus as defined in claim 1, further comprising baffle means attached to inner walls of said housing for guiding the circulating liquid toward at least one of said containers through which the web was previously guided.

5. The apparatus according to claim 1 further comprising an additional guide roller disposed adjacent to said first guide roller, which directs the web coming from the previous treatment stage to said second guide roller of said treatment stage.

* * * * *